US005791400A

United States Patent [19]

Brzytwa et al.

[11] Patent Number: 5,791,400

[45] Date of Patent: Aug. 11, 1998

[54] LINEAR SCAN HOT SPOT DETECTION SYSTEM

[75] Inventors: Tadek C. Brzytwa, Wellsville; Barry E. Campbell, Canisteo, both of N.Y.

[73] Assignee: ABB Air Preheater, Inc., Wellsville, N.Y.

[21] Appl. No.: 674,361

[22] Filed: Jul. 1, 1996

[51] Int. Cl.[6] ..... F23L 15/02

[52] U.S. Cl. ..... 165/8; 165/5; 165/11.2; 376/248

[58] Field of Search ..... 165/5, 6, 8, 11.1, 165/11.2; 376/248, 245

[56] References Cited

U.S. PATENT DOCUMENTS

| | | | |
|---|---|---|---|
| 3,144,900 | 8/1964 | Stockman | 165/5 |
| 3,730,259 | 5/1973 | Wixson et al. | 165/5 |
| 4,022,270 | 5/1977 | Stockman | 165/5 |
| 4,192,372 | 3/1980 | Bellows | 165/5 |
| 4,383,572 | 5/1983 | Bellows | 165/5 |
| 4,515,747 | 5/1985 | Creek et al. | 165/11.2 X |
| 4,656,509 | 4/1987 | Matsuyama et al. | 165/11.2 X |
| 4,971,140 | 11/1990 | Stoss | 165/5 X |
| 5,165,841 | 11/1992 | Asano et al. | 165/11.2 X |

FOREIGN PATENT DOCUMENTS

| | | | |
|---|---|---|---|
| 2514173 | 11/1976 | Germany | 165/5 |
| 0003602 | 1/1979 | Japan | 165/11.2 |
| 3241288 | 10/1991 | Japan | 165/5 |
| 0625122 | 8/1978 | U.S.S.R. | 165/5 |

*Primary Examiner*—Ira S. Lazarus
*Assistant Examiner*—Christopher Atkinson
*Attorney, Agent, or Firm*—Alix, Yale & Ristas, LLP

[57] ABSTRACT

A hot spot detection system for a rotary regenerative preheater has a linear rail system positionable between the central portion and the casing of the air preheater. The rail assembly has a pair of rails with a carriage movably mounted to each rail. The drive assembly has a motor and sprocket drive mountable to the exterior of the casing for driving the chain to which each carriage is affixed, to move the carriages in a linear reciprocating motion. On each carriage is a sensor assembly for detecting hot spots on the rotor of the air preheater.

16 Claims, 6 Drawing Sheets

LINEAR SCAN HOT SPOT DETECTION SYSTEM

BACKGROUND OF THE INVENTION

The present invention relates to the detection of hot spots in rotary regenerative air preheaters. More specifically, the invention relates to a scanning mechanism for improved hot spot detection.

Rotary regenerative air preheaters are commonly used to transfer heat from the flue gases exiting a furnace to the incoming combustion air. Fires can occur in such air preheaters, most often during cold start-up or during a start-up following a hot standby. These fires occur because of poor combustion of the fuel which results in unburned or partially burned fuel in the flue gas condensing and depositing on the air preheater element. As the temperatures entering the air preheater increase, the deposit becomes baked on to form a hard varnish-like material. This baking takes place in the 205°–260° C. (400°–500° F.) temperature range and these deposits can ignite as temperatures increase to the 315°–370° C. (600°–700° F.) range.

Ignition usually starts in a small area of the deposit and the plant operators may often be unaware that a fire has occurred. During the initial stages of ignition, external effects may not be apparent. The deposit typically restricts the flow of gas or air so that little of the excess heat generated by the fire is carried away. Furthermore, downstream mixing of the fluids minimizes the external effects and masks the existence of the fire. In addition, the heat generated is absorbed by the metal heat transfer element in the location of the fire. Actual temperature buildup may be relatively slow. If the hot spot can be detected early, the amount of water required to quench the air preheater element below the ignition temperature will not be excessive. However, if there is no early detection, the air preheater element surfaces will continue to increase in temperature to the point where the metal itself may ignite. This can occur at about 705° C. (1300° F.) and then temperatures can increase rapidly to 1650° C. (3000° F.) or more in a matter of minutes. Such metal fires are self sustaining and require large quantities of water to drop the temperature to a reasonable level. Fire extinguishers other than water, such as carbon dioxide and others, are ineffective in these situations because they lack a sufficient cooling effect.

In order to prevent fires from occurring, systems have been developed for detecting overheating conditions (hot spots) and trigger an alarm. These detection systems preferably employ an infrared detector or sensor because of its rapid response time and sensitivity to small changes in the background temperature. The sensitivity of the infrared system is adjustable but can be set to trigger an alarm when hot spots at 95°–150° C. (200°–300° F.) above the flue gas inlet temperature are detected.

Present hot spot detection systems generally have multiple infrared sensors for monitoring hot spots on the air preheater rotor. The sensors mount to a sensor drive assembly for moving the sensors to measure temperatures over the entire preheater rotor. The sensor drive assembly generally extends from the central portion of the air preheater to the outer periphery. A plurality of typically two to four evenly spaced swing arms extend from the drive assembly. An infrared sensor is mounted to each swing arm for the sensing of hot spots. The required number of swing arms and sensors generally varies directly in relation to the size of the preheater. Each swing arm moves the respective sensor in an arced path of approximately 180° to obtain full coverage of the radius of the rotor. The sensor and sensor drive assembly components, including the drive motor and ports of the sensor drive assembly are typically mounted through the side of the cold end center section of the air preheater.

The required drive mechanism, levers, linkages and swing arms of the sensor drive assembly can take up a substantial space inside the air preheater. The space required for the conventional sensor drive assembly typically can interfere with various structural members such as the pipe bracing for the air ducts. This interference results in less than optimal spacing of the sensors relative to the air preheater element. The closest the sensors can be to the heating element is approximately 30–40 inches depending on the height of the center section on which the drive mechanism is mounted.

Furthermore, the drive motor, hoses and ports to support and drive the sensors are located in the center section of the preheater. The location of these components in the center section makes for close working conditions and difficulty when servicing the sensor drive assembly and the sensor heads.

The present hot spot detection systems can exhibit several operational deficiencies. The sweeping arc travel of the sensors results in wasted motion across the rotor surface. In addition, the number of required drives, linkages and swing arms to move the sensors for full rotor coverage can lead to decreased reliability of the present hot spot detection systems.

SUMMARY OF THE INVENTION

Briefly stated, the linear scan hot spot detection system of the invention has a linear rail assembly generally extending from the center to the periphery of the rotor cavity. The rail assembly preferably supports two carriage assemblies for linear motion thereon. A drive mechanism located on the exterior wall of the air preheater shuttles the carriages between the central portion and the peripheral portion of the rotor cavity. Each carriage assembly supports a single infrared sensor assembly head for detecting hot spots on the air preheater rotor. The linear reciprocating motion of the two carriages results in complete detection coverage for the rotating air preheater rotor.

The linear scan hot spot detection system of the invention requires only two sensor assemblies for complete scanning detection of full-size preheaters. Varying the length of the rail assembly allows the detection system to be used in preheaters of differing sizes without requiring additional or different sensor assemblies or drive components. The hot spot detection system simplifies the required mechanical parts and therefore results in decreased cost and increased detection system reliability.

The drive motor, reducer, ports for water, air and electrical connections and other components are positioned on the exterior of the casing of the air preheater. The exterior location of the components allows for all maintenance to be performed on the outside of the air preheater in an improved and safer working environment. Therefore, maintenance and repair of the linear hot spot detection system is simplified.

As a further improvement, the scanning heads are positioned closer to the air preheater element for improved hot spot detection due to the low profile of the drive assembly. The rail assembly and drive mechanism have generally horizontal orientation inside the casing resulting in a reduced height for the hot spot detection system. The vertically oriented components such as the drive assembly are positioned outside the casing.

Operationally, the reciprocal linear motion of the hot spot detection system reduces wasted motion of the scanning heads across the rotor surface compared to conventional hot spot detection systems.

An object of the invention is to provide a hot spot detection system having improved hot spot detection.

Another object of the invention is to provide a less complicated more reliable hot spot detection system.

It is another object of the invention to provide a hot spot detection system that can be maintained from outside the air preheater.

A further object of the invention is to provide a hot spot detection system that can be positioned closer to the air preheater element for improved hot spot detection.

An even further object of the invention is to provide a hot spot detection system requiring a reduced number of scanning heads to perform hot spot detection.

A still further object of the invention is to provide a hot spot detection system universally applicable to air preheaters of different diameters.

These and other objects of the invention will be readily apparent from the specification and accompanying drawings.

DESCRIPTION OF THE PREFERRED EMBODIMENT

Figure 1:
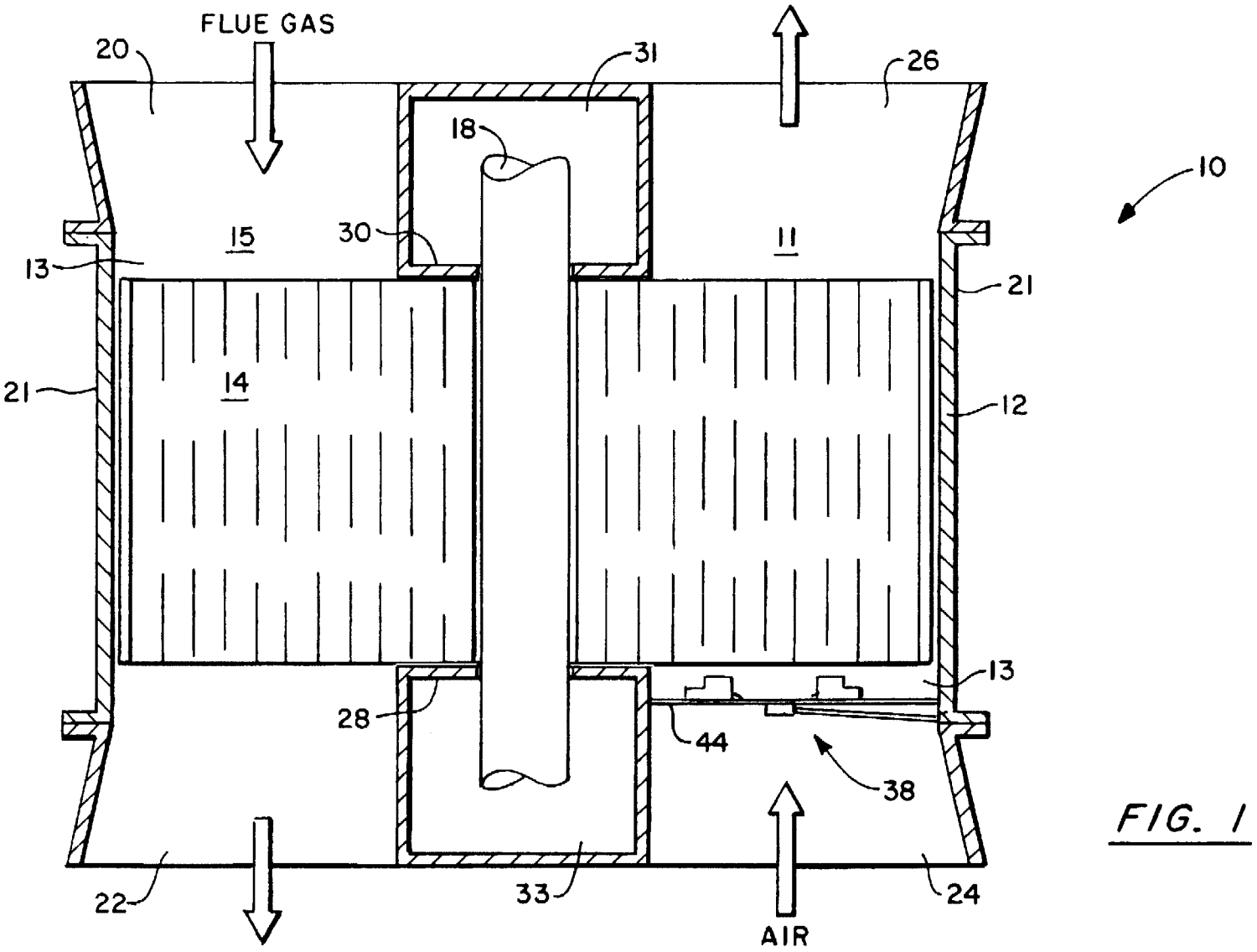
FIG. 1 is a cross-sectional schematic side view of an air preheater employing the linear scan hot spot detection system of the invention.

A rotary regenerative air preheater is generally designated by the numeral 10. The preheater 10 has a cylindrical housing or casing 12 defining an internal casing volume 13 and an exterior surface 21. Rotatably mounted within the casing 12 is a rotor 14 having conventional heat exchange elements for the transfer of heat. (See FIG. 1) The rotor 14 further has a shaft 18 to support the rotor 14 for rotation. The shaft 18 extends through a hot end center section 31 and a cold end center section 33.

Figure 2:
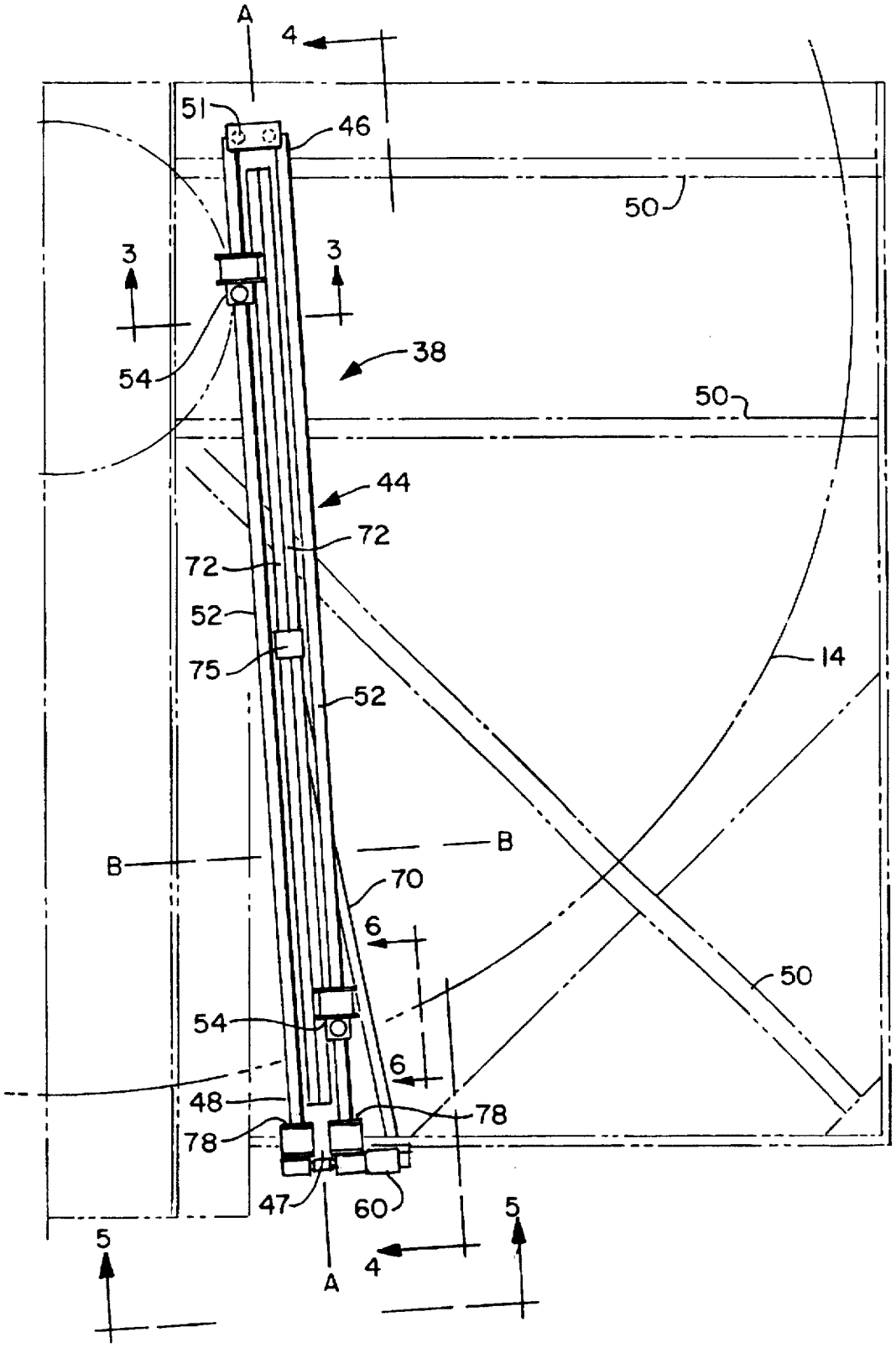
FIG. 2 is a partial cross-sectional top view, partially in phantom, of the linear hot spot detection system of FIG. 1.

The casing 12 further defines a flue gas inlet duct 20, a flue gas outlet duct 22, an air inlet duct 24 and an air outlet duct 26. Braces 50 are positioned across the inlet and outlet ducts 20, 22, 24, 26 for enhanced structural support of the casing 12. (See FIG. 2) Extending across the casing 12 adjacent to the upper and lower faces of the rotor 14 are sector plates 28 and 30 which divide the preheater 10 into the air side 11 and the flue gas side 15. The arrows of FIG. 1 indicate the direction of air and flue gas flow through the preheater 10. Hot flue gas entering through the flue gas inlet duct 20 transfers heat to the air preheater elements as the rotor 14 continuously turns. The heated air preheater elements are then rotated into the air side 11 of the preheater 10 where the heat is transferred to the combustion air stream entering the air inlet duct 24.

A linear scan hot spot detection system 38 is located in the casing 12 at the air inlet duct 24. (See FIG. 1) The linear scan hot spot detection system 38 is preferably positioned below the rotor 14 at the air inlet duct 24 for detection of hot spots on the air preheater rotor 14. The detection system 38 extends generally between the center of the casing and the periphery of the casing 12. The linear scan hot spot detection system 38 has a linear rail assembly 44 extending generally radially and horizontally across the casing 12 at the air inlet duct 24. The inboard end 46 of the rail assembly 44 mounts to the casing 12 generally near the casing center. (See FIG. 2) The outboard end 48 of the rail assembly 44 is affixed to the casing 12 at the casing periphery. It should be recognized that the detection system 38 can be positioned at any of the inlet or outlet ducts 20, 22, 24 26 for hot spot detection.

Figure 3:
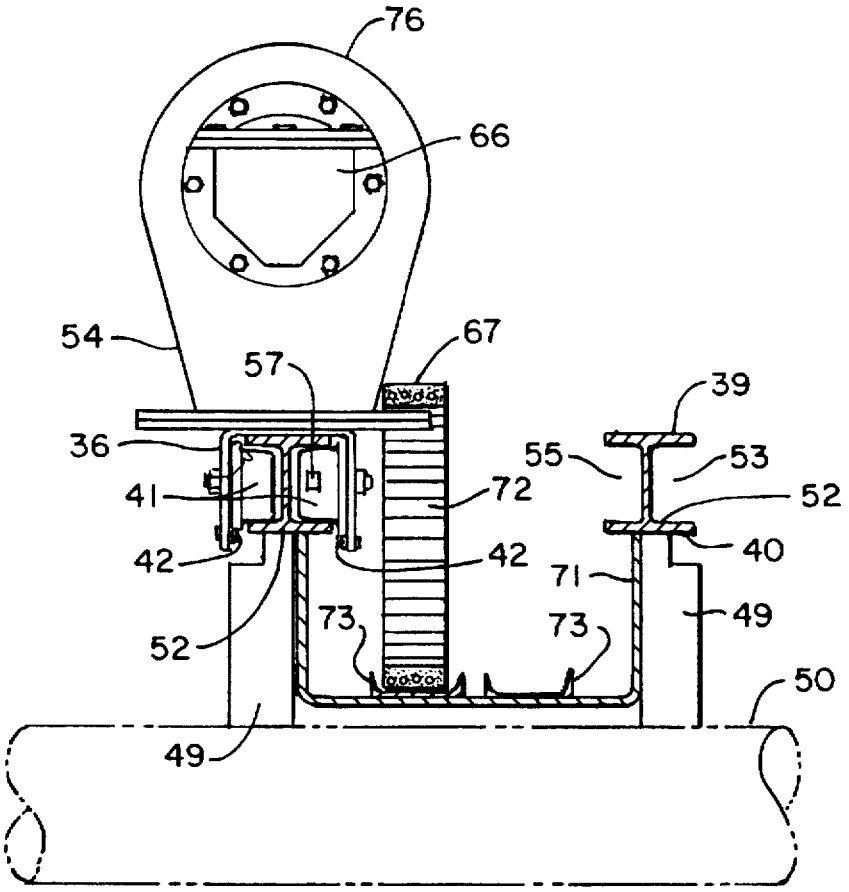
FIG. 3 is a partial cross-sectional end view, taken along the line 3—3 of the linear hot spot detection system of FIG. 2.
Figure 4:
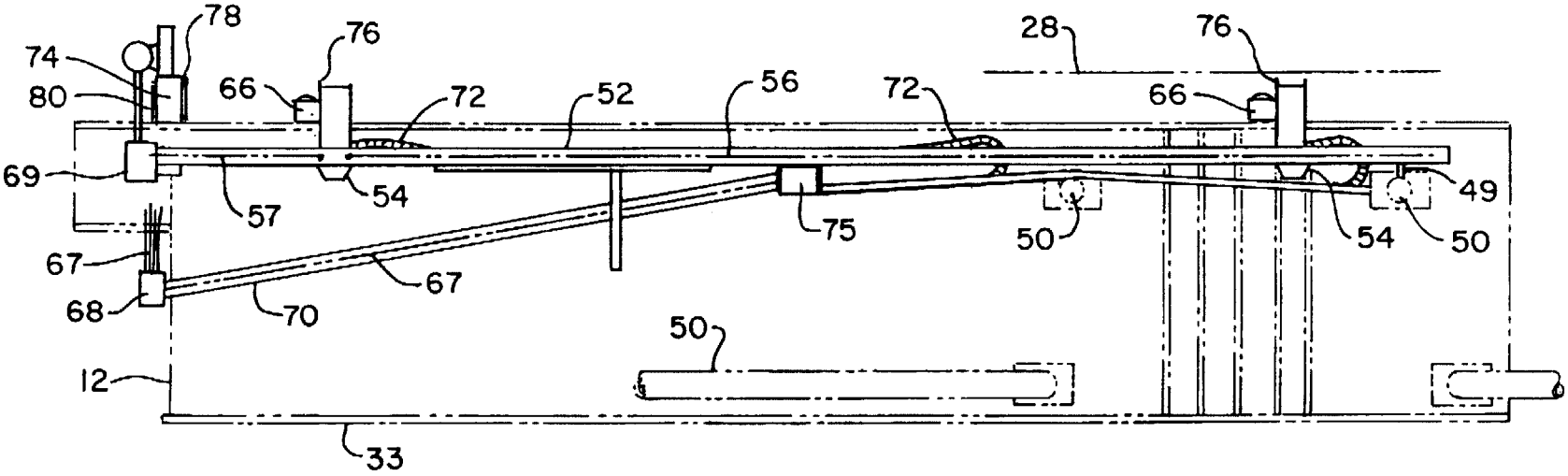
FIG. 4 is a side view, partially in phantom, taken along the line 4—4 of the linear hot spot detection system of FIG. 2.
Figure 6:
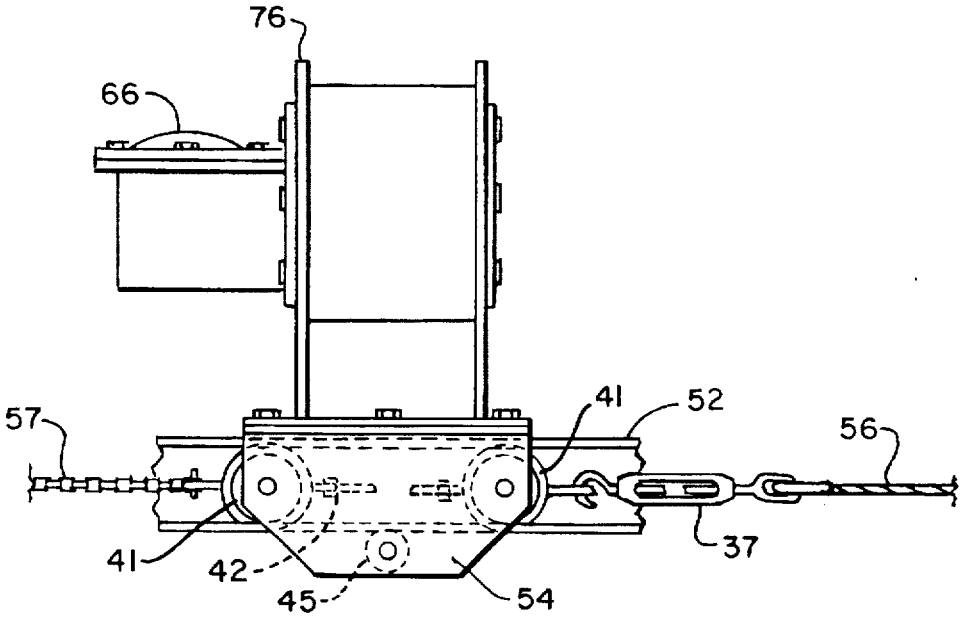
FIG. 6 is an enlarged fragmentary side view, partially in phantom, taken along 6—6 of the carriage, detector head and rail of FIG. 2.

The rail assembly 44 has a pair of parallel spaced apart linear rails 52 for support of a pair of carriages 54. (See FIGS. 3 and 6) The rails 52 are mounted to the casing 12 and mounted near the center section of the preheater. The rails 52 can be further supported by brackets 49 fixed to the rails 52 and the bracing 50. Each rail 52 has a generally "T"-shaped cross-section. An upper flange 39 and a lower flange 40 on each rail 52 define an outside rail opening 53 and inside rail opening 55. One carriage 54 is movably mounted to each rail 52. The carriages 54 have U-shaped carriage frames 36 extending over the upper flange 39 and in front of the rail openings 53, 55. Pairs of flanged carriage wheels 41 rotatably mounted to the carriage frame 36 rollingly engage the lower flange 40 inside the rail openings 53, 55 of the rail 52. A pair of rollers 45 also rotatably mounted to each carriage frame 36 rollingly engage the lower surface of each lower flange 40 to maintain the carriage frame 36 on the rail 52 for smooth linear motion thereon. The rails 52 define a longitudinal axis A and a transverse axis B generally orthoginal to the longitudinal axis A. The hot spot detection system 38 is generally symmetrical across the longitudinal axis A.

Figure 8:
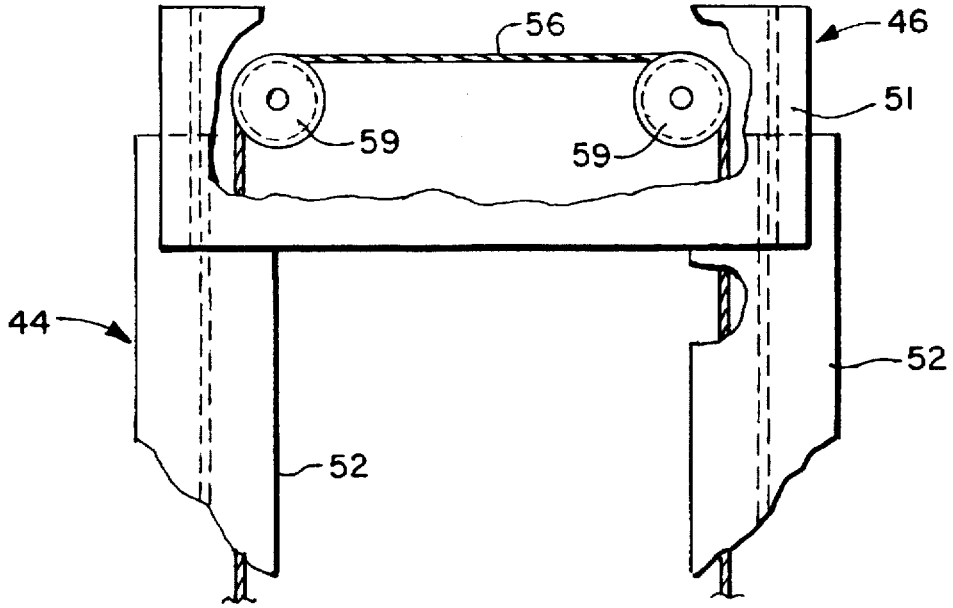
FIG. 8 is an enlarged fragmentary top plan view, partially broken away, of the inboard end of the rail system of FIG. 2.

A drive assembly 58 moves the carriages 54 along the rails 52 in opposite linear reciprocating motions. The drive assembly 58 has a single chain 57 extending along the inside rail opening 55 of each rail and affixed to each carriage frame 36 by a threaded adjustable chain mount 42. (See FIG. 6) A wire cable or rope 56 extends along the inside rail opening 55 of each rail and is affixed to each carriage by a threaded adjustable rope mount 37. (See FIG. 6) The chain 57, wire rope 56 and carriages 54 therefore define a continuous loop. The single chain 57, when driven, simultaneously moves both carriages 54 on the rail assembly 44 in opposite directions along the longitudinal axis A. A pair of pulley wheels 59 are rotatably mounted to a pulley mount 51 at the inboard end 46 of the rail assembly 44 to guide the wire rope 56 from the inside rail opening 53 of one rail 52 to the inside rail opening 53 of the other rail 52. (See FIG. 8)

Figure 7:
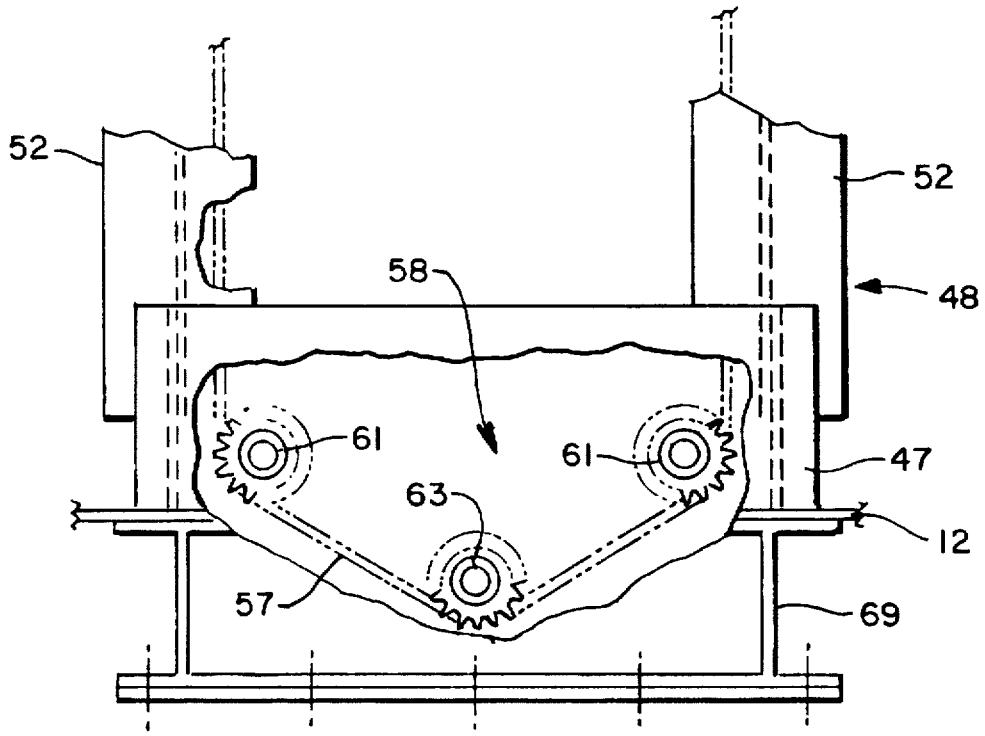
FIG. 7 is an enlarged fragmentary sectional view, partially broken away, taken along 7—7 of the drive sprocket assembly of FIG. 5.

At the outboard end 48 of the rail assembly 44 the chain 57 passes through the casing 12 and through a drive assembly 58 generally mounted to the exterior surface 21 of the casing 12 before reentering the casing 12. The drive assembly 58 has a pair of idler sprockets 61 for guiding the chain 57 into the inside rail openings 53 of the rails 52. The idler sprockets are rotatably mounted to a sprocket mount 47 fixed to the outboard end 48 of the rail assembly 48 and the casing 12. (See FIG. 7) A turnbuckle 37 on the wire rope 56 rotatably adjusts to maintain sufficient tension in the wire rope 56 and chain 57 and therefore prevent the chain 57 and wire rope 56 from sagging and rubbing on the flanges 39, 40 of the rails 52. (See FIG. 6)

Figure 5:
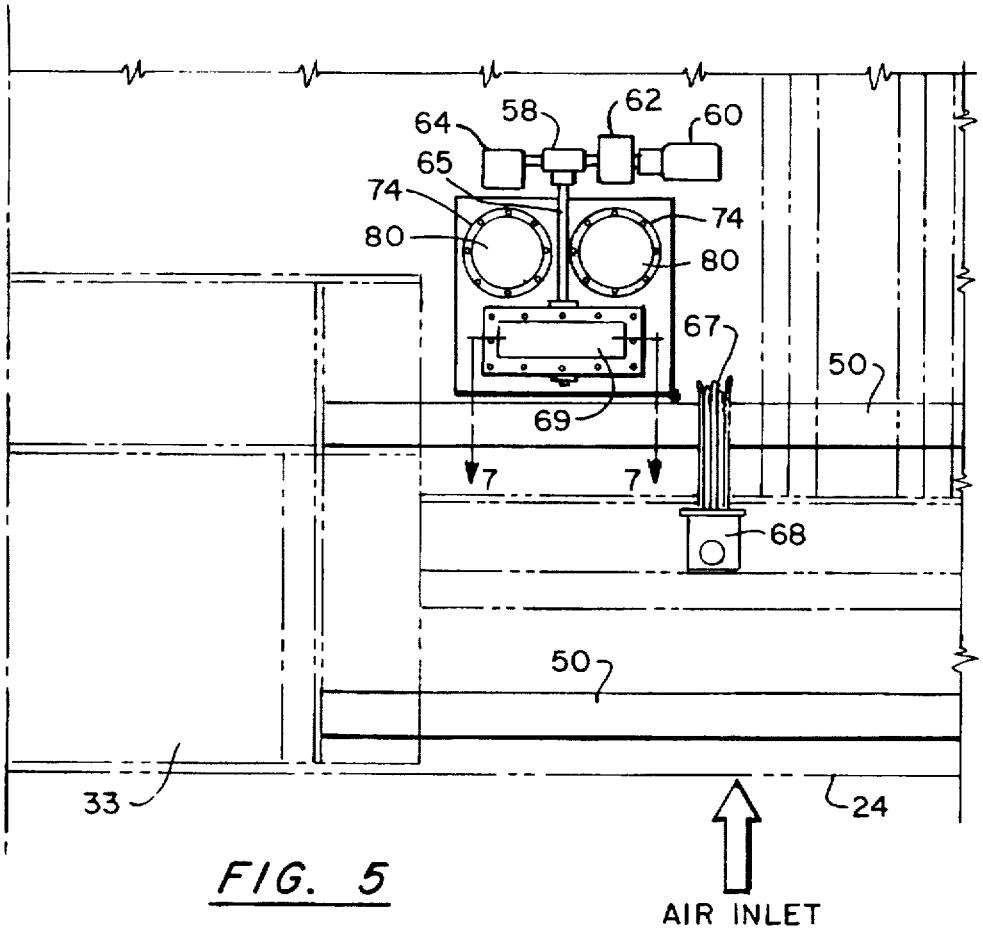
FIG. 5 is an end-on view, partially in phantom, taken along 5—5 of the linear hot spot detection system of FIG. 2.

A rotatable drive sprocket 63 engages the chain 57 to move the chain 57 and therefore the carriages 54 on the rail assembly 44. A reversible motor 60 operating through a double reduction reducer 62 drives the drive sprocket 63 via a drive shaft 65 in an alternating rotary motion. The carriages 54 therefore travel in opposite linear directions wherein when one carriage 54 is at the inboard end 46 of the rail assembly 44, the other carriage 54 is at the outboard end 48 of the rail assembly 44. The drive sprocket 63 is positioned in a drive housing 69 mounted to the exterior of the casing 12. The drive shaft 65 extends through the drive housing to rotate the drive sprocket 63. A four cam limit switch 64 is manually set based on carriage position to control reversing of the motor 60 to produce the continuous opposite linear reciprocal motion of the carriages 54. (See FIG. 5)

In operation, rotation of the drive sprocket 63 by the motor 60 tensions one end of the chain 57 therefore pulling one of the carriages 54 toward the outboard end 48 of the rail assembly 44. The tension in the chain 57 is transferred through the carriage 54 to the wire rope 56, rotating the pulleys 59 and pulling the other carriage 54 toward the inboard end 46 of the rail assembly 44. Reversal of the rotation of the drive sprocket 63 tensions the other end of the chain therefore pulling the other carriage 54 toward the outboard end 48 and the first carriage 54 toward the inboard end 46 of the rail assembly 44.

Affixed to each carriage 54 is a sensor assembly 66. The sensor assemblies 66 preferably employ an infrared sensor for detection of hot spots on the air preheater rotor 14. The sensor assemblies 66 can alternatively use thermocouples, various thermistors and ultra-violet detectors to detect thermal differences on the rotor 14. Each sensor assembly 66 is preferably positioned centered over the respective rail 52 and on the respective carriage frame 36 for improved balanced motion of the carriage 54 and sensor assembly 66 on the rail 52.

A set of water, air and electrical cables 67 supply each of the sensor assemblies 66 and allow transmission of signals from the sensor assemblies 66 to sensor displays (not shown). Each set of cables 67 enters the air preheater 10 through a cable port 68 in the casing 12. The sets of air, water and electrical cables 67 extend through an angled rigid cable housing 70 located below the rail assembly 44. The rigid cable housing 70 is approximately half the length of the rail assembly 44 and terminates at a cable mount 75 fixed to approximately the middle of the rail assembly 44. Each set of cables 67 then continues to extend through a separate flexible segmented cable housing 72 mounted at one end to the cable mount 75 and at the other end to one of the carriages 54. The flexible cable housings 72 define moving U-shaped paths between the rails 52 as the carriages 54 move along the rail assembly 44. A generally U-shaped cable tray 73 mounted between the rails 52 and from the lower flange 40 of each rail 52 vertically supports the flexible cable housings 72. The cable tray 73 has longitudinal cable guides 73 for maintaining the flexible cable housings 72 in parallel relation to the rails 52 as the carriages 54 move along the rails 52. (See FIG. 3)

Access ports 74 are formed in the casing 12 for maintenance and repair access to each carriage 54 and sensor assembly 66. Each access port 74 is generally located in line with the travel path of one of the carriages 54. Port covers 80 sealingly engage each access port 74 to seal the casing 12 during operation of the preheater 10. A flange 76 extends from each carriage 54 to sealingly engage a gasket 78 on the internal side of each access port 74 when the respective carriage 54 is at the limit of motion at the outboard end 48 of the rail assembly 44. When the carriage 54 is at the limit of motion, the sensor 66 on the carriage 54 extends into the access port 74. The port cover 80 can then be removed for sensor maintenance and repair.

In operation, the opposing linear reciprocal motion of the linear scan hot spot detection system 38 in combination with the rotary motion of the rotor 14, results in full scanning hot spot detection coverage of the air preheater rotor 14. The low profile of the detection system 38 allows the system 38 to be optimally positioned approximately 21 inches from the rotor 14 and above the bracing 50 supporting air inlet duct 24 for improved hot spot detection.

While a preferred embodiment of the present invention has been illustrated and described in detail, it should be readily appreciated that many modifications and changes thereto are within the ability of those of ordinary skill in the art. Therefore, the appended claims are intended to cover any and all of such modifications which fall within the true spirit and scope of the invention.

We claim:

1. A rotary regenerative preheater comprising:

a casing defining an internal casing volume and an exterior surface, said internal casing volume having a central portion and a peripheral portion;

rotor means rotatably mounted in said casing for transferring heat from a flue gas stream to an air stream;

rail means comprising a linear rail extending between said peripheral portion and said central portion;

carriage means movably mounted to said rail means;

sensor means for detecting hot spots on said rotor means, said sensor means mounted to said carriage means;

drive means connected to said carriage means for moving said carriage means on said rail means between said central portion and said peripheral portion; and cable means for supplying said sensor means, and cable housing means comprising a flexible housing portion, said cable means in said flexible housing portion and said flexible housing portion defining a U-variable shaped path.

2. The rotary regenerative preheater of claim 1 wherein said drive means comprises a sprocket drive assembly and a chain fixed to said carriage means and engaging said sprocket drive assembly.

3. The rotary regenerative preheater of claim 1 further comprising:

second carriage means movably mounted to said rail means and connected to said drive means for moving said second carriage means on said rail means between said central portion and said peripheral portion.

4. The rotary regenerative preheater of claim 2 wherein said chain and said carriage means define a continuous loop and said sprocket drive assembly is mounted to said exterior surface for driving said chain.

5. The rotary regenerative preheater of claim 1 wherein said sensor means comprises an infrared sensor.

6. The rotary regenerative preheater of claim 1 wherein said linear rail has an "T"-shaped cross section defining rail openings and said carriage means comprises wheels positioned in said openings and rollingly engaging said rail.

7. The rotary regenerative preheater of claim 1 wherein said cable housing means further comprises a rigid housing portion.

8. A rotary regenerative preheater comprising:

a casing defining an interior volume and an exterior surface, said interior volume having a central portion and a peripheral portion;

rotor means rotatably mounted in said internal casing volume for transferring heat from a flue gas to an air stream;

rail means comprising a plurality of linear rails extending between said peripheral portion and said central portion;

a plurality of carriage means, each said carriage means movably mounted to one of said rails;

sensor means mounted to each said carriage means, said sensor means adapted to detect hot spots on said rotor means;

drive means for moving said carriage means on said rail means between said central portion and said peripheral portion, said drive means comprising a drive assembly mounted to said exterior surface;

cable housing means in said interior volume, said cable housing means having a rigid cable housing portion and a flexible cable housing portion, said rigid cable housing portion mounted to said casing and said flexible cable housing portion mounted to one of said carriage means; and cable means extending from said exterior surface through said cable housing means to said one carriage means.

9. The rotary regenerative preheater of claim 8 wherein said linear rails have a generally "T"-shaped cross section defining channel openings.

10. The rotary regenerative preheater of claim 9 wherein said carriage means comprise wheels positioned in said rail openings and rollingly engaging said linear rails.

11. The rotary regenerative preheater of claim 8 wherein said sensor means comprises an infrared sensor.

12. A hot spot detection system for detection of hot spots in a rotary regenerative preheater, said detection system comprising:

rail means comprising a pair of adjacently positioned parallel rails;

first carriage means movably mounted to one of said rails;

second carriage means movably mounted to the other of said rails;

detector means on each said carriage means for detecting hot spots;

drive means for moving said first and second carriage means in opposite reciprocal linear motions on said respective rails.

13. The hot spot detection system of claim 12 wherein said drive means comprises a chain, means for fixing each said carriage means to said chain, and sprocket drive means for driving said chain.

14. The hot spot detection system of claim 13 wherein said drive means further comprises a flexible rope fixed to said first and second carriage means, said chain said first and second carriage means and said rope forming a continuous loop.

15. The hot spot detection system of claim 12 further comprising cable means for supplying said detector means and cable housing means for housing said cable means, said cable housing means comprising a rigid cable housing portion and a flexible cable housing portion, said flexible cable housing portion mounted to said carriage means and said cable means extending through said rigid housing portion and through said flexible housing portion.

16. A rotary regenerative preheater comprising:

a casing defining an internal casing volume and an exterior surface, said internal casing volume having a central portion and a peripheral portion;

rotor means rotatably mounted in said casing for transferring heat from a flue gas stream to an air stream;

rail means comprising a linear rail having an "T"-shaped section defining rail openings and extending between said peripheral portion and said central portion;

carriage means movably mounted to said rail means said carriage means comprising wheels positioned in said rail openings and rollingly engaging said rail;

sensor means for detecting hot spots on said rotor means, said sensor means mounted to said carriage means; and drive means connected to said carriage means for moving said carriage means on said rail means between said central portion and said peripheral portion.

* * * * *